United States Patent [19]

Klein

[11] Patent Number: 4,766,913

[45] Date of Patent: Aug. 30, 1988

[54] MICROPROCESSOR CONTROLLED HAIR TREATMENT APPLIANCE

[75] Inventor: Gustave J. Klein, Great Neck, N.Y.

[73] Assignee: Revlon, Inc., New York, N.Y.

[21] Appl. No.: 444,147

[22] Filed: Nov. 24, 1982

[51] Int. Cl.[4] ..... A45D 20/20

[52] U.S. Cl. ..... 132/9; 34/99; 219/222

[58] Field of Search ..... 132/9; 34/76, 99; 364/900

[56] References Cited

U.S. PATENT DOCUMENTS

| | | | |
|---|---|---|---|
| 3,754,216 | 8/1973 | Kekas et al. | 364/900 |
| 3,934,596 | 1/1976 | Suntheimer | 132/9 |
| 4,124,034 | 11/1978 | Myerhoefer | 132/33 R |
| 4,256,127 | 3/1981 | Tsujimoto | 132/9 |
| 4,259,566 | 3/1981 | Kobayashi | 34/99 |
| 4,352,248 | 10/1982 | Kobayashi | 34/99 |

*Primary Examiner*—Richard J. Apley
*Assistant Examiner*—J. Welsh

[57] ABSTRACT

A hair treatment system and appliance which are precisely and accurately controlled by a microprocessor in which data stored in memory is utilized to control different types of hair treatment programs for different types of hair. The system is utilized in association with a head bonnet adapted to be placed about the hair being treated and having a heater therein for heating the hair during the treatment program. A control panel allows a selection and entry to be made on the type and porosity of the hair to be treated, from eleven different possible combinations thereof indicated on the panel. A memory has stored therein a treatment time and temperature for each of the possible combinations, and a processing circuit is responsive to the particular entry to retrieve the proper treatment time and temperature from memory. A separate temperature sensor probe is utilized to detect the temperature produced by the heater at the hair during its treatment. The processing circuit monitors the temperature sensor, and is responsive to its output to control the heater, maintaining it substantially at the temperature retrieved from memory. The processing circuit further monitors the treatment time, and turns off power to the heater after the correct treatment time has elapsed.

9 Claims, 4 Drawing Sheets

MICROPROCESSOR CONTROLLED HAIR TREATMENT APPLIANCE

BACKGROUND OF THE INVENTION

1. Field of the Invention

The present invention relates generally to an improved hair treatment system and appliance, and more particularly pertains to a hair treatment system and appliance which is precisely and accurately controlled by a microprocessor. The subject invention precisely controls the application of heat to hair during the application of a treatment thereto, for instance during a conditioning treatment or a permanent program.

2. Discussion of the Prior Art

All permanent waves function by opening primary bonds in the hair. If insufficient primary bonds are opened, the hair is considered underprocessed and the permanent will not last. On the opposite extreme, overprocessed hair will be dry, have excessive breakage and appear frizzy. A hair stylist often controls the treatment, and frequently utilizes a test curl to measure the progress thereof. A conventional way to confer a permanent or durable wave to hair is to allow a waving agent to react on the hair at room temperature. This is called cold waving. However, in this instance the waving agent, for example thioglycolate, must be relatively strong in order to react on the hair at room temperature. Thus, there is a substantial risk that the waving agent will damage the skin of the hair stylist or the hair of a patron. In addition, since the time period in which the waving agent reacts on the hair is determined primarily by the feeling and experience of a beautician, the degree of hair waving is occasionally too little or too great.

An improvement over cold waving is the application of a hair treatment program in conjunction with heat, in which case the relationships between time, temperature, concentration of treatment formulas, and the unique characteristics of the hair being treated, afford many controlled variables to the stylist during the hair treatment program. The taking of a test curl during a hot permanent is particularly disadvantageous in that a plastic cap normally placed over the patron's head must be opened to take the test curl, which cools the head and slows the treatment. Moreover, the test curl procedure might have to be repeated several times during a program.

Tsujimato et al., U.S. Pat. No. 4,258,731, as well as related patents Tsujimato et al., U.S. Pat. No. 4,256,127 and Itogawa et al., U.S. Pat. No. 4,292,985, are of particular interest to the present invention. The first mentioned patent discloses a hair waving appliance having a bonnet in which the head of a patron is positioned. The bonnet has a plurality of infrared radiation lamps therein which serve as sources of heat for the different hairline areas during a treatment program. The bonnet also includes a plurality of individual temperature sensors which monitor the temperatures at the individual hairline areas. A microcomputer receives inputs applied via an input keyboard on the individual temperature and treatment times, and controls operation of the infrared lamps. In this arrangement, the temperatures and heating times of the separate heaters are entered into the microcomputer which then controls the individual heaters accordingly. Accordingly, in this reference, the microprocessor is utilized only in a control function or sense in which it controls the individual heaters and times their operational periods. In contrast thereto, the present invention operates in a substantially different fashion in which various treatment times and temperatures for several different treatments for different types of hair are permanently stored in memory, and are then selectively recalled to control the hair treatment program.

SUMMARY OF THE INVENTION

Accordingly, it is a primary object of the present invention to provide a hair treatment system and appliance which are precisely and accurately controlled by a microprocessor.

A further object of the subject invention is the provision of a hair treatment system and appliance of the type described in which data stored in memory is utilized to control different types of hair treatment programs for different types of hair.

In accordance with the teachings herein, the present invention provides an improved hair treatment system which is utilized in association with a head bonnet adapted to be placed about the hair being treated and having a heater therein for heating the hair during the treatment program. A control panel allows a selection and entry to be made on the type of hair to be treated, from a plurality of possible hair types indicated on the panel. A memory has stored therein a treatment time and temperature for each of the plurality of possible hair types indicated on the control panel. A processing circuit is responsive to the entry of the particular hair type to retrieve the proper treatment time and temperature from the memory. A separate temperature sensor probe is utilized to detect the temperature produced by the heater at the hair during its treatment. The processing circuit then monitors the temperature sensor, and is responsive to its output to control the heater of the head bonnet, maintaining it substantially at the temperature retrieved from memory. The processing circuit further monitors the treatment time, and turns off power to the heater after the correct treatment time has elapsed. In the preferred embodiment, the processing circuit advantageously comprises a microprocessor integrated circuit having the memory as one component thereof.

Pursuant to the disclosed appliance, the control panel is located on a console mounted in an elevated position above a base, and an AC power outlet is provided on the base for a separate heated head bonnet. In this arrangement, the microprocessor cycles AC power on and off to the AC power outlet plug to control the temperature of the hair, thereby maintaining it substantially at the temperature retrieved from memory. The temperature sensor is mounted in a probe which is designed to be secured directly to the hair being treated, and the probe is coupled to the console by electrical wiring and a plug jack connector. The control panel has a two dimensional array of selector switches thereon, with one axis of the array indicating the classification or type of the hair to be treated and the second axis of the array indicating the porosity of the hair. Moreover, the preferred embodiment is designed to allow a selection between two different types of treatment programs for the hair, either a conditioning program or a permanent program, and the control panel includes two selector switches to allow the selection and entry of either a conditioning or a permanent program. The memory has stored therein both a conditioning program treatment time and temperature and a permanent program treatment time and temperature for each of the types of hair indicated on the control panel. Moreover, the display panel has a plurality of LED selection indicators thereon, one LED for each hair type to indicate the selection entered, and one LED for each of the conditioning and permanent programs to indicate the selected program.

BRIEF DESCRIPTION OF THE DRAWINGS

The foregoing objects and advantages of the present invention for a microprocessor controlled hair treatment appliance may be more readily understood by one skilled in the art with reference being had to the following detailed description of several preferred embodiments thereof, taken in conjunction with the accompanying drawings wherein like elements are designated by identical reference numerals throughout the several views, and in which.

DETAILED DESCRIPTION OF A PREFERRED EMBODIMENT

Figure 1:
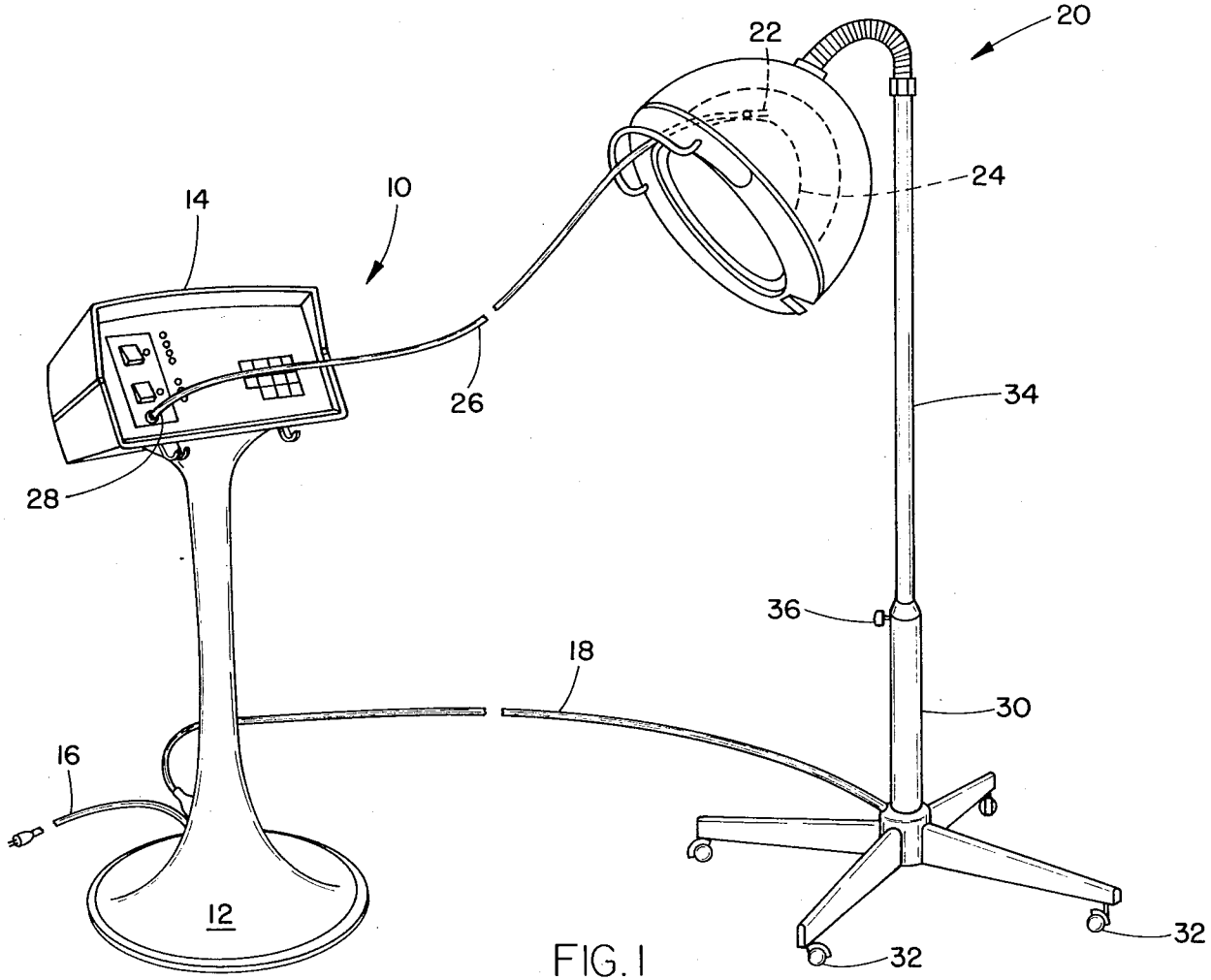
FIG. 1 is a perspective view of an exemplary embodiment of a microprocessor controlled hair treatment system constructed pursuant to the teachings of the present invention.
Figure 3:
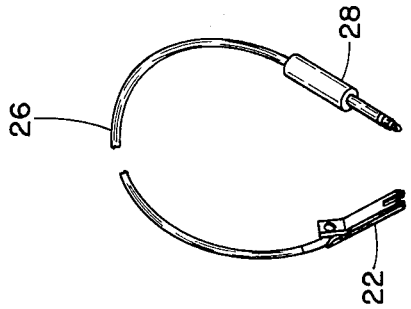
FIG. 3 illustrates an unplugged temperature sensing probe, as taught herein.

Referring to FIG. 1, the present invention is exemplified by an appliance 10 having a circular base 12 upon which a control and selection console 14 is mounted in an elevated position. The appliance is plugged into an AC power outlet by a power supply line 16 extending from its base, and an AC power outlet is also provided on the base for electrical connection by a power supply line 18 to a separate heated head bonnet 20. In this arrangement, the appliance cycles AC power on and off to the AC power outlet plug to control the temperature of the hair, thereby maintaining it substantially at a temperature retrieved from a memory in the appliance. A temperature sensor is mounted in a probe 22 which is designed to be secured directly to the hair being treated, with the top and back of the head being shown in phantom at 24. The probe is coupled to the console by electrical wiring 26 and a plug jack connector 28, such that it is detachably connected thereto.

The exemplary embodiment is designed for utilization with a separate, traditional hair dryer bonnet 20. If the hair dryer has separate controls, the temperature control should be set to hot and the timer to a maximum, such that the temperature of the hair dryer bonnet is controlled solely by cycling the AC power applied thereto through the electrical cord 18. A typical hair dryer appliance includes a base 30 mounted on casters or rollers 32 such that it is mobile, and the height of the bonnet is adjustable through a vertically extensible support shaft 34, and secured by an adjustment screw and handle 36.

Figure 2:
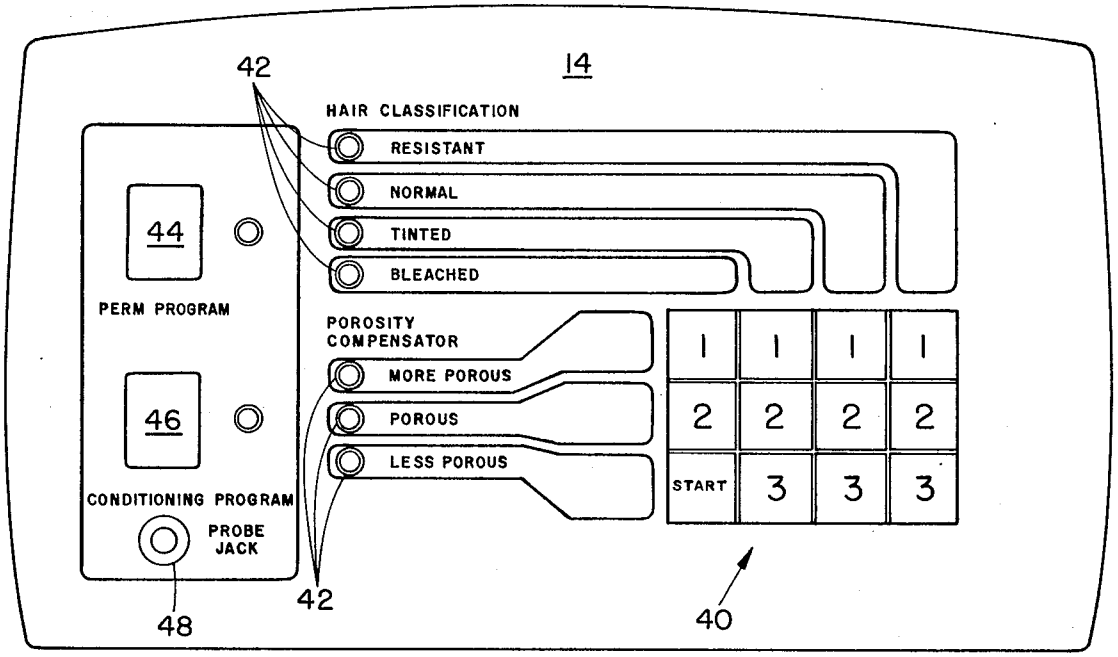
FIG. 2 illustrates an enlarged view of the control panel on the appliance of FIG. 1.

The front panel of the control and selection console 14 is illustrated in greater detail in FIG. 2. A pushbutton switch array 40 of twelve switches allows a hair stylist to select and enter in the console a person's hair type and hair porosity. Four columns of switches provide for four types of hair (left column—bleached, left middle column—tinted, right middle column—normal, right column—resistant). Three rows of switches indicate the hair porosity (upper row—more porous, middle row—normally porous, bottom row—less porous). The professional judgement of the hair stylist is an important factor in the selection of hair type and porosity, and the stylist may additionally take into consideration other recent treatments to the person's hair. Porosity is an important factor as it is an indication of the ability of the hair to absorb a fluid such as a permanent or conditioning lotion.

Each of the four types of hair classification and three types of porosity is provided with an LED (Light Emitting Diode) indicator light 42 to verify the particular chosen selection to the operator.

The lower left switch in the array is utilized as a START switch to initiate operation of the present invention. The illustrated embodiment is also provided with a selection between two optional treatment programs, a permanent program selected by a switch 44, and a conditioning program selected by a switch 46. Alternative embodiments of the subject invention could provide only one available program or more than two available programs. A female connector 48 is also provided for the plug jack connector 28.

Figure 5:
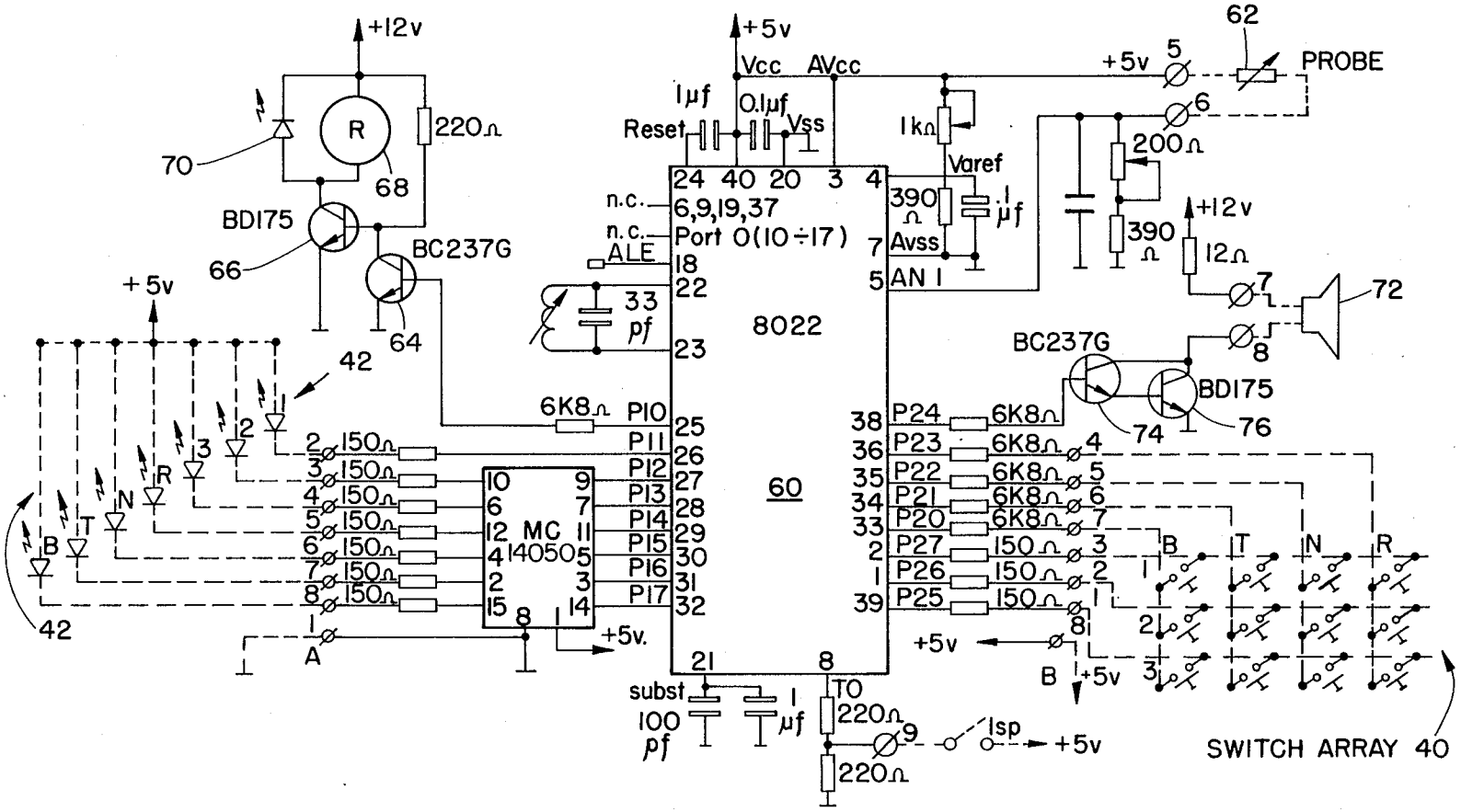
FIG. 5 is a schematic of the control processing circuit, illustrating the major components and interconnections thereof.

The present invention includes a programmed microprocessor, described in greater detail in association with FIG. 5, which has in memory a selected temperature and treatment time for the selected treatment (either conditioning or a permanent) for each of the eleven provided combinations of types of hair and hair porosity. Naturally, the temperature and treatment time for each of the eleven given selections of hair depends directly upon the chemistry of the treatment lotion, and so the disclosed embodiment is designed for use only with predetermined lotions which are supplied to the hair stylist. The present invention could be designed for utilization with many different types of lotions, and the tempereature and treatment time for each lotion would have to be separately entered and stored in the memory of the microprocessor.

As an example only, the following sets of treatment times and temperatures were selected for one particular type of permanent program and chemistry and one particular type of a conditioning program and chemistry.

TABLE I

| | | |
|---|---|---|
| Sensor Perm Program | | |
| Bleached 1 | 3 minutes | 29.4° C. |
| Bleached 2 | 5 minutes | 29.4° C. |
| Tinted 1 | 7 minutes | 35° C. |
| Tinted 2 | 8.5 minutes | 35° C. |
| Tinted 3 | 10 minutes | 35° C. |
| Normal 1 | 12.5 minutes | 46.1° C. |
| Normal 2 | 14.5 minutes | 46.1° C. |
| Normal 3 | 16 minutes | 46.1° C. |
| Resistant 1 | 20 minutes | 51.6° C. |
| Resistant 2 | 22 minutes | 51.6° C. |
| Resistant 3 | 24 minutes | 51.6° C. |
| Acconditioning Program | | |
| Bleached 1 | 13 minutes | 42° C. |
| Bleached 2 | 12 minutes | 42° C. |
| Tinted 1 | 11 minutes | 39° C. |
| Tinted 2 | 10 minutes | 39° C. |
| Tinted 3 | 9 minutes | 39° C. |
| Normal 1 | 8 minutes | 36° C. |
| Normal 2 | 7 minutes | 36° C. |
| Normal 3 | 6 minutes | 36° C. |
| Resistant 1 | 5 minutes | 33° C. |
| Resistant 2 | 4 minutes | 33° C. |

TABLE I-continued

| | | |
|---|---|---|
| Resistant 3 | 3 minutes | 33° C. |

The aforementioned times and temperatures can be stored in memory in the microprocessor in binary equivalents to the decimal values given above, or as described in greater detail below. The memory is preferably a Read/Write type of memory, such that if the chemistry of a particular program is ever changed, the times and temperatures for that program can be changed in memory by a qualified electronics technician.

The temperature sensor in probe 22 is a key element in the present invention, and can be a thermistor type of element, the electrical resistance of which varies inversely with the measured temperature. For the Sensor Perm Program given above, the temperature of the program is the same for each of the four possible hair selections, and the four temperatures can be translated into four resistances for a particular thermistor. In greater detail, the preferred embodiment equates temperature to resistance of the temperature probe, and turns the heater on when the measured probe resistance (indicative of temperature) reaches a first given value and turns the heater off when the measured probe resistance (indicative of temperature) reaches a second given value. Since the resistance of a typical thermistor varies inversely with temperature, the first given value, in TABLE II below, which is indicative of a lower temperature, is a higher resistance. The two resistance values are then chosen to cycle the hair heater on and off, substantially maintaining the hair temperature at the value given in the aforementioned TABLE I.

In the disclosed embodiment, a power relay is turned on and off to cycle electrical power to the hair heater, and the following electrical resistances were suitable for one particular type of thermistor temperature probe. Moreover, the acuation circuit for the electrical power relay is designed with a three seconds delayed response time to prevent quick on/off cycling of the relay coil.

In the Sensor Perm Program, the electrical power supply relay is on (closed) in the first value and is open (off) at the second value.

TABLE II

| | | | |
|---|---|---|---|
| Bleached | 8450 | 8057 | (Sensor probe ohms) |
| Tinted | 6687 | 6383 | (Sensor probe ohms) |
| Normal | 4277 | 4093 | (Sensor probe ohms) |
| Resistant | 3455 | 3312 | (Sensor probe ohms) |

In the Acconditioning program, the comparable resistances are:

| | | | |
|---|---|---|---|
| Bleached | 5000 | 4700 | (Sensor probe ohms) |
| Tinted | 5640 | 5310 | (Sensor probe ohms) |
| Normal | 6400 | 6100 | (Sensor probe ohms) |
| Resistant | 7300 | 6900 | (Sensor probe ohms) |

As mentioned above, the times and temperatures (or resistance values) in memory are directly related to the chemistry of the particular program. For the particular Acconditioning program referred to herein, the timing of the program is not initiated until the temperature rises to 27° C. Accordingly, after pressing the START switch, the power relay for the heater is turned on, and the measured temperature begins to rise. However, the timing measurement does not begin until the measured resistance of the probe decreases to a value equal to 27° C.

Figure 4:
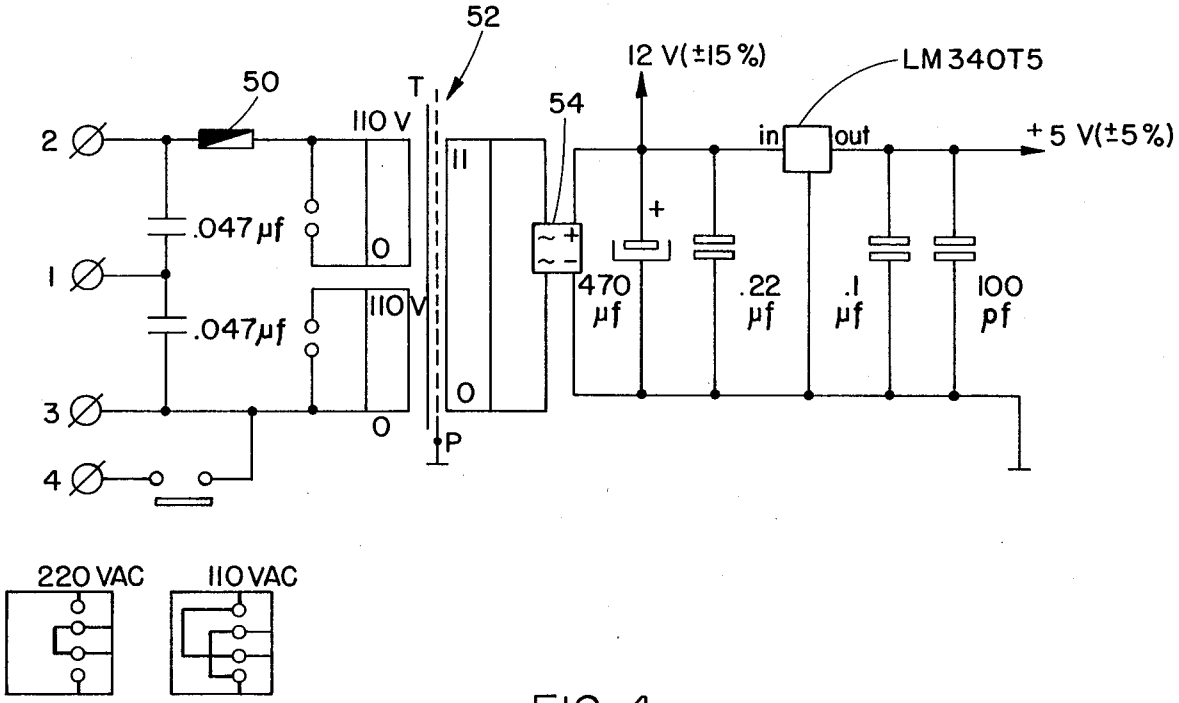
FIG. 4 is a schematic of the power supply circuit for the subject invention.

FIG. 4 is a schematic of the power supply circuit for the present invention, which is somewhat customary in design. The inputs at the left are coupled to either a 110 or 220 VAC power supply, connected as shown therebelow through a fuse 50 to a step down transformer 52, through a rectifier 54, which delivers approximately a 12 VDC unregulated voltage to a voltage regulator integrated circuit, LM340T5 or equivalent, which produces a 5 VDC regulated supply voltage for the circuit of FIG. 5.

Referring to FIG. 5, there is illustrated the main control circuit of the present invention which is constructed around an 8022 microprocessor 60 connected as shown. Many of the symbols and terminology illustrated therein are conventional in nature, and accordingly will not be explained in detail herein as they are conventional. These include the pin and port connections to the microprocessor and the normal input and output signals and voltages associated therewith.

The inputs from the switch array 40 are coupled through pins 20–23 and 25–27 to the microprocessor 60 to allow entry therein of the hair classification and porosity and also of the START input. Depending upon the particular selection, the microprocessor enables two of output pins 10–17 to drive the appropriate two LEDs 42 on the console display to indicate thereon both the chosen hair classification and porosity. The LEDs 42 may be driven through an integrated circuit MC 14050, or equivalent, which includes therein six separate buffer amplifiers, or may be driven directly.

The variable resistance thermistor 62 of the thermal probe is coupled to port 5 of the microprocessor, which contains therein, in a known manner, a Digital to Analog (D/A) converter for converting the resistance value to a digital equivalent, which is then compared, pursuant to the programming of the microprocessor, with the upper and lower binary values of resistance retrieved from memory. In an alternative embodiment, the D/A converter can be a conventional type of D/A circuit external of the microprocessor, rather than an integral part thereof. If the currently sensed value of the resistance is higher than the left column resistance value in TABLE II, then after the START switch is pressed, the heater in the head bonnet is actuated and remains actuated until the sensed resistance becomes equal to or less than the right column resistance given in TABLE II. The microprocessor actuates the heater by an output signal on pin 10 which drives a collector to base arrangement of transistors 64, 66, which in turn actuate the power relay 68 to supply AC power to the electrical outlet in the base 12, into which the power cord 18 of the bonnet 20 is plugged. An actuation diode 70 can also be included therein, such that an LED 70 on the display panel 14 is lighted during periods electrical power is supplied to the hair heater. In this manner, AC power to the heater in the bonnet is cycled on and off as the resistance of the thermistor varies between the appropriate two values given in TABLE II.

The present invention can also include an acoustic transducer in the form of a small loudspeaker 72 mounted behind the display panel 14. An emitter to base coupled arrangement of transistors 74, 76 drives the loudspeaker at a suitable acoustic frequency when an output signal is applied to the base of transistor 74 by pin 24 of the microprocessor. Thus, the microprocessor can be programmed to supply audible signals to the hair stylist and patron during the operation of the present invention. For instance, the microprocessor can be programmed to produce audible tones when entries are correctly made on the control panel 14, or can be programmed to generate audible alarm sounds when an incorrect condition exists, for instance if the jack connector 28 is removed during a treatment program or if the hair temperature exceeds a given upper limit, both of which conditions can be determined by the sensed resistance of the thermal probe. Moreover, the audible sounds can also indicate the end or nearness of the end of the hair treatment program, or if the operation has not followed the correct sequence of steps in administering a hair treatment program with the present invention.

All of the electronic components of the present invention can be suitably mounted directly within the control and selection console. In one program of the present invention the following features and attributes were included in the programming. After pressing the appropriate selection pushbuttons and then the START pushbutton, all of the pushbuttons are deactivated such that there is no effect if any of them are pressed again prior to the end of the particular hair treatment program. An alarm sound is activated if the temperature is greater than 57° C. (to prevent failure of the power relay), or lower than 12° C., or if there is a short circuit or an open circuit in the sensor probe. If the sensor probe is incorrectly connected, the alarm sound is also activated. This sound has two tones, one long, such that it is significantly different than other program sounds. Moreover, to improve the accuracy of the sensor probe measurement, several consecutive readings thereof can be averaged to obtain each measurement output.

While a preferred embodiment and several variations of the present invention for a microprocessor controlled hair treatment system and appliance are described in detail herein, it should be apparent that the disclosure and teachings of the present invention will suggest many alternative designs to those skilled in the art. For instance, for both the permanent and conditioning programs, slightly different chemical lotions can be supplied, which may be selected by the hair stylist on the basis of the fineness or the coarseness of the hair. Those portions of the microprocessor program which might be changed from time to time can be programmed in a Read/Write type of memory, commonly referred to as RAM memory, while a ROM (Read Only Memory) memory can be utilized for other portions. The flexibility of reprogramming the microprocessor to accommodate desired changes in operation of the present invention is a very desirable attribute. All of the programming sequences referred to herein, including those of the timing functions, are relatively simple and basic in nature, such that the programming or changes therein would be well within the level of skill of a basic programmer. Programming techniques such as are explained in detail in MICROPROCESSOR USER'S GUIDE, by Pro-Log Corporation, 1979 can be applied to develop or modify the program. The timing functions described herein can be implemented, in a well known manner, by utilizing the microprocessor clock, counted down and gated, to obtain the treatment time periods stored in memory. When the measured time equals or exceeds the time period retrieved from memory, the microprocessor output at pin 10 is terminated and the transducer 72 is suitably actuated at pin 24.

Moreover, it may be desirable to have separate and different thermal probes for the permanent program and the hair conditioning program. The thermistors might even be different to accommodate different temperature ranges or for some other reason.

What is claimed is:

1. Apparatus for treating hair in association with a head bonnet adapted to be placed about the hair being treated and having a heater for heating the hair during the treatment, comprising:

a. a control panel having a plurality of selection switches, with each selection switch representing a different hair type for allowing the selection and entry of the type of hair to be treated from a plurality of possible hair types indicated thereon;

b. a temperature sensor for detecting the temperature produced by the heater at the hair during the treatment thereof;

c. a binary memory having stored therein as binary words a treatment time and temperature for each of the plurality of switches for the possible hair types indicated on the control panel; and d. a processing circuit means, comprising a microprocessor having said memory as a component thereof, responsive to the entry by actuation of a switch for the selected hair type, for retrieving from said memory the treatment time and temperature therefor, said processing circuit being responsive to said temperature sensor for controlling the heater of the head bonnet to maintain it substantially at the temperature retrieved from memory during the treatment, said processing circuit further including a timer for timing the treatment time retrieved from memory to turn off the head bonnet heater after the measured treatment time.

2. Apparatus for treating hair as claimed in claim 1, including an AC power outlet plug for a separate head bonnet, said processing circuit means cycling AC power on and off to said AC power outlet plug to control the heater of the head bonnet to maintain it substantially at the temperature retrieved from memory during the hair treatment.

3. Apparatus for treating hair as claimed in claim 2, comprising a console mounted elevated above a base, said control panel being on said console and said AC power outlet being on said base.

4. Apparatus for treating hair as claimed in claim 3, said temperature sensor being mounted in a probe which is designed to be secured directly to the hair being treated, said probe being connected by an electrical connector to a plug connector on said console.

5. Apparatus for treating hair as claimed in claim 1, said control panel having an array of selector switches thereon, with one axis of the array indicating the classification of the hair to be treated, and a second axis of the array indicating the porosity of the hair to be treated.

6. Apparatus for treating hair as claimed in claim 5, for enabling two different types of treatment, either a conditioning program for the hair, or a permanent program therefor, said control panel including selector switches for allowing the selection and entry of either a conditioning program or a permanent program, and said memory having stored therein both a conditioning treatment time and temperature, and a permanent treatment time and temperature for each of the plurality of hair types indicated on the control panel.

7. Apparatus for treating hair as claimed in claim 6, said display panel having a plurality of LED selection indicators thereon, one LED for each type of hair in the array for indicating the selected hair type, and one LED for each of the conditioning and permanent programs for indicating the selected program.

8. Apparatus for treating hair as claimed in claim 1, said temperature sensor being mounted in a probe which is designed to be attached to the hair being treated.

9. Apparatus for treating hair as claimed in claim 1, said memory comprising a Read/Write memory.

* * * * *